US009181064B2

(12) United States Patent
Barea

(10) Patent No.: US 9,181,064 B2
(45) Date of Patent: Nov. 10, 2015

(54) METHOD AND DEVICE FOR FEEDING A YARN OR THREAD TO A PROCESSING MACHINE WITH CONSTANT TENSION AND VELOCITY

(75) Inventor: Tiziano Barea, Busto Arsizio (IT)

(73) Assignee: BTSR INTERNATIONAL S.P.A., Olgiate Olona (VA) (IT)

( * ) Notice: Subject to any disclaimer, the term of this patent is extended or adjusted under 35 U.S.C. 154(b) by 211 days.

(21) Appl. No.: 13/640,359

(22) PCT Filed: May 17, 2011

(86) PCT No.: PCT/IB2011/001072
§ 371 (c)(1),
(2), (4) Date: Oct. 10, 2012

(87) PCT Pub. No.: WO2011/144987
PCT Pub. Date: Nov. 24, 2011

(65) Prior Publication Data

US 2013/0056573 A1 Mar. 7, 2013

(30) Foreign Application Priority Data

May 18, 2010 (IT) ..... MI2010A0887

(51) Int. Cl.
*B65H 51/30* (2006.01)
*B65H 59/38* (2006.01)
(Continued)

(52) U.S. Cl.
CPC ..... *B65H 59/388* (2013.01); *B65H 51/30* (2013.01); *D04B 15/44* (2013.01); *D04B 15/48* (2013.01); *D04B 15/50* (2013.01); *B65H 2701/31* (2013.01)

(58) Field of Classification Search
CPC ..... B65H 59/06; B65H 59/38; B65H 59/384; B65H 59/385; B65H 59/387; B65H 59/388; B65H 51/30; B65H 2701/31; D04B 15/44; D04B 15/46; D04B 15/48; D04B 15/50
See application file for complete search history.

(56) References Cited

U.S. PATENT DOCUMENTS 4,752,044 A * 6/1988 Memminger et al. ..... 242/365.7
5,738,295 A 4/1998 Flamm et al.

(Continued)

FOREIGN PATENT DOCUMENTS

CN 87106691 A 5/1988
CN 1671903 A 9/2005

(Continued)

OTHER PUBLICATIONS

Search Report dated Sep. 13, 2013 from Chinese application 201180022011.4, filed May 17, 2011.
International Search Report dated Feb. 24, 2012 from international application PCT/IB2011/001072.
Office action and translation of Office action from corresponding Japanese application 2013-510690, mailed Nov. 4, 2014.

*Primary Examiner* — William E Dondero
(74) *Attorney, Agent, or Firm* — Novak Druce Connolly Bove + Quigg LLP

(57) ABSTRACT

A method for feeding a yarn or thread to a processing machine, such as a textile machine, the method includes unwinding the yarn from a bobbin, bringing it into cooperation with a rotary member and then directing it to a sensor member arranged to verify its feed tension to the processing machine, with monitoring of the yarn feed velocity. The measured tension and measured velocity data being fed to a control unit which controls the yarn feed to the machine. The tension is continuously controlled by the unit to maintain it constant then, if this tension condition is verified, the velocity is controlled to render it constant, while at the same time the tension value is continuously monitored to verify whether it remains constant. This constant tension and constant velocity control of the yarn feed to the processing machine being implemented without synchronization with the machine.

18 Claims, 2 Drawing Sheets

(51) Int. Cl.

| | |
|---|---|
| ***D04B 15/44*** | (2006.01) |
| ***D04B 15/48*** | (2006.01) |
| ***D04B 15/50*** | (2006.01) |

(56) References Cited

U.S. PATENT DOCUMENTS

| | | | | |
|---|---|---|---|---|
| 6,105,895 | A * | 8/2000 | Schmodde et al. | 242/420.6 |
| 6,123,283 | A | 9/2000 | Hayashi et al. | |
| 6,676,054 | B2 * | 1/2004 | Heaney et al. | 242/131 |
| 7,303,163 | B2 * | 12/2007 | Huss et al. | 242/418.1 |
| 2005/0173579 | A1 * | 8/2005 | Barea | 242/365.7 |
| 2006/0184267 | A1 | 8/2006 | Huss et al. | |
| 2007/0227197 | A1 | 10/2007 | Corsani | |
| 2008/0210804 | A1 * | 9/2008 | Barea | 242/416 |

FOREIGN PATENT DOCUMENTS

| | | | |
|---|---|---|---|
| CN | 1070455 | C | 9/2007 |
| EP | 0926091 | A2 | 6/1999 |
| EP | 950742 | A2 * | 10/1999 |
| EP | 1125880 | A2 | 8/2001 |
| JP | 59-25505 | A | 7/1982 |
| JP | 61-174066 | A | 1/1985 |
| JP | 2006-225051 | A | 2/2005 |
| WO | 0202856 | A2 | 1/2002 |
| WO | 03085183 | A1 | 10/2003 |
| WO | 2005111287 | A1 | 11/2005 |

* cited by examiner

METHOD AND DEVICE FOR FEEDING A YARN OR THREAD TO A PROCESSING MACHINE WITH CONSTANT TENSION AND VELOCITY

CROSS-REFERENCE TO RELATED APPLICATIONS

This application is a §371 National Stage Application of International Application No. PCT/IB2011/001072, filed on 17 May 17, 2010, claiming the benefit of Italian Patent Application No. MI2010A 000887 filed on 18 May 2010.

The present invention relates to an improved method for feeding a yarn or thread to a processing machine, such as a textile machine or a machine operating on metal wires, in accordance with the introduction to the main claim. The invention also relates to a device for implementing said method in accordance with the corresponding independent claim.

With particular but non-limiting reference to the textile field, it has long been known that the quality of a textile article is intrinsically related to the method of feeding the yarn and in particular to its feed tension and feed velocity or the quantity fed (absorbed yarn length). In consideration of this fact, various technological solutions are known in the state of the art for the various types of machines (small, medium, large-diameter circular machines, straight bar machines, etc.) aimed at improving the quality of the final product.

For example, constant velocity yarn feeders are known which withdraw the yarn from a spool and deposit it on a drum rotated at constant velocity by a belt connected to a transmission shaft which rotates a cylinder of the textile machine. This type of feeder ensures a yarn quantity (absorbed yarn length) which remains constant with time, however this solution has presented numerous problems such as the obtaining of the necessary synchronization between the rotational velocity of said drum and the machine absorption rate, as the velocity ratio determines the yarn tension. To find the correct velocity ratio and hence the correct tension involves very lengthy adjustment times before starting production. Moreover the device which implements said known method presents other limits related to the thermal expansion of the stitch forming members (for example from machine cold to machine hot) which result in a variation in their travel, with consequent variation in the yarn fed quantity. Any wear of the mechanical parts of these members (needles, sinkers and cams) results in further variations in the yarn quantities absorbed by each position, with consequent formation of defects (barring) in the fabric.

A limit of this known solution is that the feed velocity (absorbed yarn length) of each yarn is constant and hence the yarns cannot be fed in a discontinuous application (jacquard) in which the yarn consumption varies on the basis of the pattern. In addition, this solution is unable to compensate any extra tensions in the yarn withdrawn from the spool, which cause yarn breakage and tension increase on the stitch forming members, resulting in defective articles and/or in the worst case the breakage of needles.

Another limit of these feed members is determined by the fact that to feed a constant yarn quantity via a feed belt and feed wheels which rotate at the same velocity assumes that the fed yarns are without elasticity, which in fact is untrue as each yarn undergoes elongation on the basis of the tension to which it is subjected. Hence different yarn tensions at the entry to constant quantity yarn feed members in reality result in different yarn quantities being fed to the textile machine.

A different yarn feed method uses constant tension yarn feeders, these being devices able to operate without any synchronization with the machine and able to maintain the tension constant during the process as the absorption rate and the spool unwinding tension vary.

The use of these feeders has in fact simplified interfacing with the machine, in addition to solving the problem of tension jerks originating from the spool (compensated by the device itself) and the problem of feeding a yarn withdrawn discontinuously by the machine (jacquard application).

However, even though these devices ensure that the tension of a yarn leaving them is constant and of the set value, the yarn tension in proximity to the needles which form the stitch varies from the set tension as it is also determined by the inevitable yarn passages through the yarn guides (ceramic or metal) positioned between the feed device and said needles.

These passages determine different friction for each position (each feeder) and hence a different yarn tension in proximity to the needles for each machine feed. This tension difference creates a different absorbed yarn length, this length being less the greater the yarn tension in proximity to the needles, with consequent production of barred fabric.

Hence although these known devices are able to maintain constant tension, they are unable to maintain an always constant fed yarn quantity (absorbed yarn length), which in certain cases is a fundamental point in ensuring the final product quality.

Moreover if said constant tension feeders are used with elastic yarns, the problem of the yarn quantity (absorbed yarn length) fed to the machine increases considerably because even if the yarn is fed at constant tension, the feed velocity varies on the basis of the spool tension and the tension resulting from friction on the deviator yarn guide (this friction is particularly high because of the intrinsic characteristics of the yarn) positioned between the feeder and the stitch formation members.

Yarn feed devices known as accumulation feeders are also known, said devices being able to withdraw the yarn from a usual bobbin and accumulate it on a drum from which it is withdrawn by the textile machine. Tensioning means cooperating with the drum from which the yarn is unwound determine the tension at which the yarn is withdrawn.

Although these devices ensure yarn withdrawal at controlled tension, they do not ensure true tension constancy as the wear of the tensioning means and the tension at which the yarn is withdrawn from the bobbin affect the tension at the device exit, with consequent possible barring of the fabric produced.

As a compromise solution between the two feed types ("constant tension" and "constant velocity") the applicant has proposed a method and device by which the yarn is fed at constant tension and controlled absorbed yarn length.

According to this method, which uses constant tension feeders, the device is able to modify the set-point tension of said feeders in order to provide a uniform feed velocity (absorbed yarn length) to a plurality of yarns fed by said feeders at a self-learnt or predetermined value. This system is hence able to ensure a feed at constant tension and controlled absorbed yarn length, and by acting on the feed tension is able to compensate the variable friction deriving from contact between the yarn and the yarn guide members which is inevitably present between the feeder exit and the stitch forming members of the machine, to hence maintain a constant tension and yarn quantity (absorbed yarn length) of the yarn fed to the machine.

However although this system operates correctly and solves the problem for rigid (or low elasticity) yarns, it is unable to operate validly with elastic yarns.

A further limit of this system is the necessary synchronization of the device with the machine operative state: in this respect, as a minimum, a synchronization signal is required, to which the device responds by verifying the difference in terms of absorbed yarn length between the amount fed and its set-point value in order to decide how to modify the operating tension for the purpose of aligning consumptions with a self-learnt or set value.

US 2006/0184267 relates to a yarn feeder system including a plurality of yarn feeders combined into one group. In the trial mode, the yarn feeders operate in an individually tension-controlled manner on the basis of a specified yarn tension value. The yarn feed quantities or yarn speeds that result from this at the various yarn feeders are reported to a central unit. From the reported yarn speeds, the central unit calculates a group average and sends this to the yarn feeders as a specified value for subsequent operation. As a result, the individual yarn feeders can subsequently operate in the purely positive mode. Moreover, the central unit can receive signals that characterize both the machine speed and pattern signals, on the basis of which the yarn feeders of the particular group that is to respond at the time are switched on and off or sped up or slowed down.

U.S. Pat. No. 4,752,044 relates to a yarn supply element that supplies the yarn substantially without slip and is rotatably supported. The element has yarn guide elements and is coupled to an electric motor of regulated frequency that drives it. In the yarn travel path following the yarn supply element, yarn tension sensing means monitor the yarn unwinding from the yarn supply element and emit an electrical signal supplied to a control circuit, which supplies the motor with a frequency signal. A device for forming a yarn reserve is provided along the yarn travel path following the yarn supply element. The size of the yarn is dimensioned to be sufficient to cover the yarn requirement during startup of the motor. Means for automatically refilling the yarn reserve to an original size no later than after the startup of the motor are provided.

It is hence evident that in the current state of the art, there does not exist a single solution able to completely solve the problems of feeding one or more yarns (whether rigid or elastic) to a textile machine, comprising the advantages of a constant tension feed for applications with discontinuous absorption (jacquard) and the advantages of constant velocity feed for applications with continuous absorption (jersey).

An object of the present invention is therefore to provide a yarn feeding method and device able to combine the advantages of constant tension feed with those of constant velocity feed (absorbed yarn length), hence overcoming all the limits of the previously described known solutions.

A further object of the present invention is to provide a yarn feeding method and device able to operate both by withdrawing the yarn directly from the spool (feed by over end takeoff, the method used for rigid or slightly elastic yarns), or by rotating the spool (feed by rolling takeoff, the method used for elastic yarns).

Another object of the present invention is to provide a yarn feeding method able to operate without any synchronization with the machine.

These and other objects which will be apparent to the expert of the art are attained by a method and device in accordance with the accompanying claims.

The present invention will be better understood from the accompanying drawings, which are provided by way of non-limiting example and in which.

Figure 1:
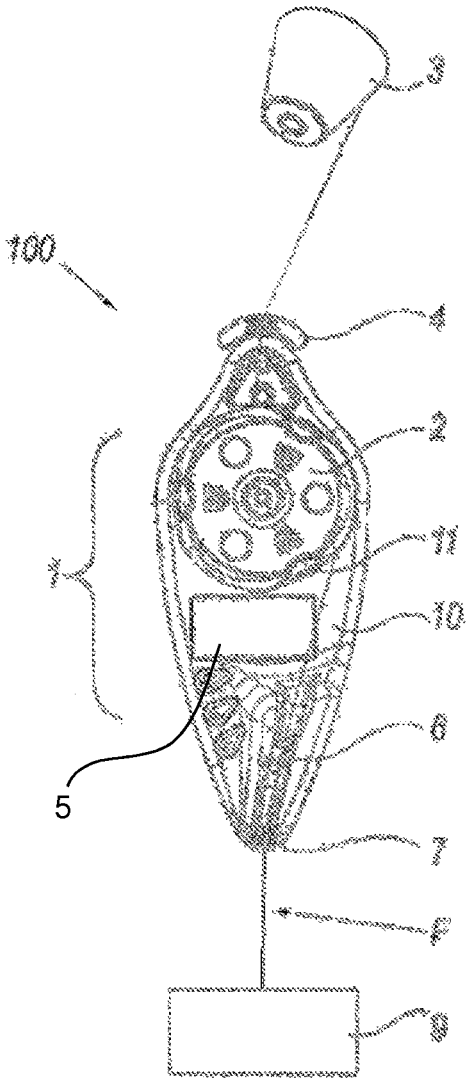
FIG. 1 is a front schematic view of a first device for yarn feed by over end takeoff operating by the method of the present invention.

With reference to FIG. 1, this shows a constant tension yarn feeder operating by over end takeoff and acting on the yarn by the method of the present invention.

The device under examination comprises a body 1 carrying a rotary member or wheel 2 (operated in known manner by its own electrical actuator, not shown) acting on a yarn F unwinding from a bobbin 3. Before reaching the wheel 2 the yarn F passes through an entry yarn guide 4, for example of ceramic, and is then wound for one or two turns onto said wheel. From this latter the yarn F arrives, in its movement towards the processing machine, which in the example is a textile machine 9, at a sensor member 6 which measures its tension (for example a load cell), and from there it reaches an exit yarn guide 7 (for example of ceramic).

The rotation of the wheel 2 is controlled by a control member or unit 10 to which the member or load cell 6 measuring the yarn tension is also connected.

As the yarn F is constrained by three mechanical members (i.e. the entry yarn guide 4, the wheel 2 and the exit yarn guide 7), the angle that the yarn assumes (triangulation) on the sensor member or load cell 6 is constant as the stages in the feed of the yarn F to the machine 9 vary; this enables this member or cell 6 to measure the yarn tension during these stages with absolute precision.

In this respect, as the device (or yarn feeder) under examination is not synchronized (or not necessarily synchronized) with the textile machine, any yarn requirement by this latter results in an increase in the tension of the yarn (withdrawn by the machine on leaving the device), which is measured by the sensor member or cell 6. This increase is processed by the control member or unit 10 which intervenes on the rotary member or wheel 2 to vary its velocity in order to maintain the tension constant. The device hence operates as a classical closed loop control system, well known to the expert of the art.

Figure 2:
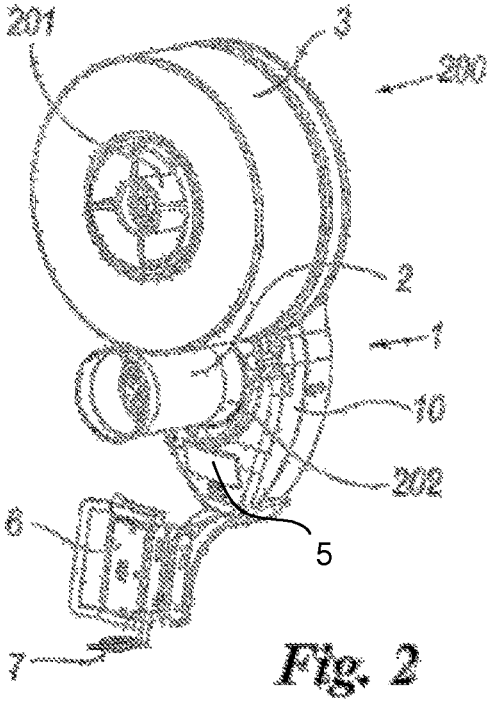
FIG. 2 is a schematic perspective view of a second device for yarn feed by rolling takeoff operating by the method of the invention.

With reference to FIG. 2, this shows a constant tension yarn feeder 200 operating by rolling takeoff in accordance with the method of the present invention. In this figure, parts identical with or corresponding to those of FIG. 1 are indicated by the same reference numerals.

The device 200 comprises a body 1 supporting a rotary member or wheel 2 (also of cylindrical shape) with which a bobbin 3 is in contact, from which the yarn F unwinds. The bobbin 3 is drawn onto an idle shaft 201 supported by the body 1 and is always in contact with the wheel 3. For this purpose a spring (not shown) or equivalent elastic pulling element acts on the shaft 201 and tends to pull it towards the wheel 2; hence whatever the quantity of yarn F on the bobbin 3, this is always in contact with the wheel or rotary member 2.

The body 1 supports, projecting from it, a tension sensor member or load cell 6, in proximity to which there is an exit yarn guide 7. A further entry yarn guide (not visible in the figure) directs the yarn F onto the wheel 2 where it can form a fraction of a turn or several turns. The sensor or cell 6 and the wheel 2 are connected to a control unit 5.

As in the case of FIG. 1, as the yarn is constrained by the three mechanical members (the entry yarn guide, the wheel 2 and the exit yarn guide 7 or ceramic guide), the triangulation on the load cell 6 is constant as the stages in the yarn feed to the textile machine vary, this enabling this load cell to measure the yarn tension during the process stages with absolute precision.

As in the case of FIG. 1, as the feeder 200 is not necessarily synchronized with the textile machine, any yarn requirement by this latter is sensed by the load cell 6 as an increase in tension, the resultant signal being processed by the control unit 10 which varies the velocity of an actuator 202 for the wheel connected to it in order to maintain the tension constant by operating as a classical closed loop control system.

Figure 3:
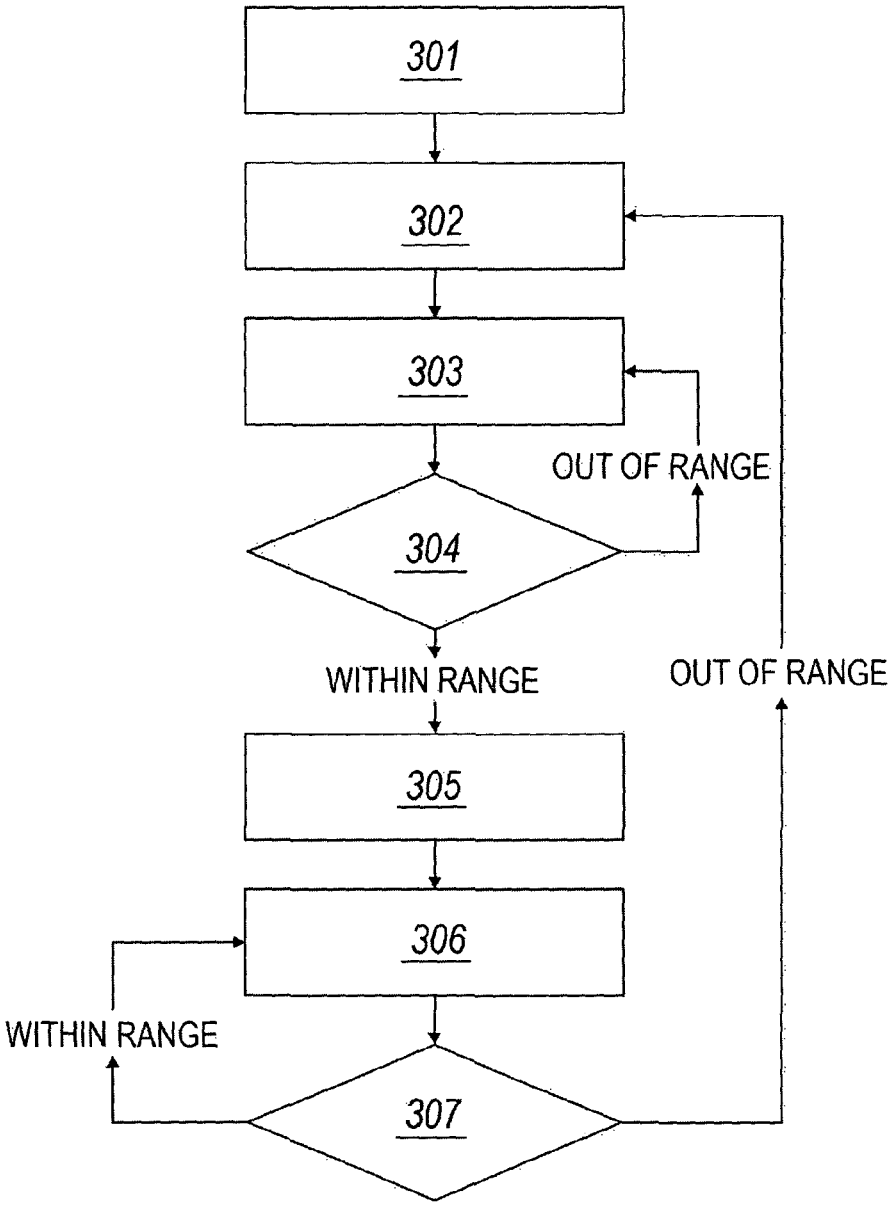
FIG. 3 shows a flow diagram of the method of the invention.

The flow diagram of FIG. 3 describes the method of the present invention, by which the feed is able to pass from constant tension feed to constant velocity feed (absorbed yarn length) totally automatically. This method is implemented equally both for the device 100 of FIG. 1 and the device 200 of FIG. 2 by the unit 10 which controls the corresponding rotary members 2.

In a first stage of the method (block 301), the device 100 or 200 is in the start-up stage during which initialization takes place of all operating variables stored in a memory of the control unit 5, preferably of microprocessor type. On termination of this stage the procedure automatically passes to the block 302. In this stage, tension control is activated followed by direct automatic passage to the stage of block 303. In this, the actuator of the rotary member 2 is controlled by the control unit 10 to maintain the tension of the yarn F equal to a constant value by increasing its velocity (and that of the corresponding rotary member 2) if the tension read by the sensor member 6 is higher than a set is value or reducing its velocity if the read tension is lower than the set value, using for example a known PID algorithm.

During this stage, the feeder device 100 or 200 is hence able to commence feeding the yarn F as soon as the machine 9 starts to require it (sensed by the device as an increase in the tension measured by the sensor member 6 relative to its set-point value) and to halt the feed as soon as this requirement ceases (sensed by a decrease in the measured tension relative to its set-point value). All this is achieved completely automatically without the need for any synchronization with the machine. During this stage the yarn feed velocity is also measured by the sensor 11, which could be at least one Hall sensor or encoder, possibly integrated into the actuator associated with the rotary member 2.

In this stage a tension check is carried out (block 304). The control unit 5 continues to monitor the tension read by the member 6 to check whether this lies within a possibly programmed range (for example ±5% of the set-point tension) for a predetermined time (also possibly programmable). If the tension lies outside this range, the control unit 5 continues to operate in the yarn constant tension control mode of operation by automatically returning to block 303. If however the "tension within range" condition is verified (measured tension within the desired range), the procedure automatically passes to block 305 after memorizing the feed velocity value (possibly filtered or mediated) at that instant, which becomes the set-point velocity. In this stage the unit 10 activates velocity control and passes directly to block 306 in which the actuator of the rotary member 2, controlled by this control unit 10 to maintain the velocity of the rotary member 2 constant, makes it equal to the self-taught value. The control unit 10 then closes its PID loop no longer on the basis of the tension but on the basis of the actuator velocity. During this control the control unit 5 also measures the yarn tension and performs the operation represented by block 307.

In the stage represented by this block, the control unit 5 continues to monitor the read tension to verify whether this lies within a possibly programmed range (for example ±5% of the set-point tension) for a predetermined time is (possibly programmable). If the tension lies within this range, the control unit 5 continues to operate in the constant feed velocity control mode of operation by automatically returning to block 306. If however the condition is verified in which the tension lies outside the range, the procedure automatically returns to block 302.

It is hence evident that if this method is implemented by each of the previously described constant tension yarn feeders 100, 200, they achieve the advantages of the two feed modes (constant tension and constant velocity), being able to pass completely independently from one operating mode to the other without any synchronization with the machine, thus being able to always feed the yarn under the best possible condition.

The method described in relation to FIG. 3 can, in a simpler embodiment, be subjected to modifications aimed at improving the performance of the device 100 or 200 which implements it.

In a first variant, the control unit 10, during constant velocity yarn feed, is able to monitor the tension not only to verify that this continues to remain within a predetermined range, but also to verify its mean variation to check whether it remains equal to the set tension and if necessary act on the velocity set-point to achieve this equality. The unit 10 is able to halt the machine 9 if the mean tension continues to deviate from the set value with time, notwithstanding a predetermined number of tension correction attempts obtained by acting on the member 2. This could in fact be caused by an accumulation of dirt in the machine yarn guide or by a loss of mechanical calibration of the members provided for stitch formation in the textile machine.

During constant velocity yarn feed, the control unit is able to monitor the variation in the instantaneous tension and determine whether this changes suddenly with time, with consequent sensing that the textile machine yarn withdrawal is not continuous but discontinuous (jacquard application). In that case even if the tension is within the range of predetermined values, the unit 10 automatically passes to the constant tension feed mode for the yarn F, which ensures greater quality in the case of discontinuous applications.

During constant tension yarn feed, the control unit 10 is not only able to monitor the tension variation to verify whether it is or is not within a predetermined range, but is able simultaneously to verify the velocity variation of the wheel 2. If this velocity is not constant but varies suddenly with time, this means that the textile machine yarn withdrawal is not continuous but discontinuous (jacquard application). In that case the unit may decide not to pass to the constant velocity yarn feed mode even though the tension is within the range, to ensure greater quality.

During constant velocity yarn feed, the control unit can have as its reference set-point not the value self-learnt at the moment of passage from the constant tension mode to the constant velocity mode, but instead a predetermined and/or programmed and/or calculated value (for example the mean of the velocity of one or more devices) in order to make the absorbed yarn lengths of several similar devices operating on corresponding yarns fed to the same machine 9 uniform at the same value, for example for the purpose of causing all those feeders which cooperate with the same yarn type or which carry out the same type of production to operate at the same velocity. In order to achieve this objective, the devices could operate in a configuration of MASTER-SLAVE type in which, for each type of yarn or production, only one of the devices is MASTER (MASTER_1, MASTER_2, MASTER_n, and all the others are SLAVE (SLAVE_1, SLAVE_

2, SLAVE_n); hence in this case the MASTER would determine the feed velocity of all associated slave devices.

In this manner a system can be defined for feeding a plurality of yarns to a textile machine, each yarn F being fed by an aforesaid feed device in accordance with the previously described method, in which the value of the yarn length absorbed by said devices is made uniform for at least part of these latter at the same value; these devices operate in master-slave configuration in which for each yarn type or production type only one of these devices is master while the others are slaves, said master device determining the feed velocity of all the associated slave devices. All the associated devices operate on yarns of the same type, with all the associated devices carrying out the same type of production.

This expedient further increases product quality without requiring any synchronization with the machine; in this respect by constantly monitoring the yarn tension and the pulley velocity, the control unit 5 can ensure yarn feed even in the case in which for example the indicated set-point is in fact mistaken, imagining for example having programmed a velocity value double that required; the control unit 5, on measuring the tension, realizes that this is outside the range and automatically passes to the constant tension mode, possibly indicating the irregularity to a supervision unit or halting the machine.

The control unit 5 could also use different ranges (in percentage terms) and/or different filters, and could use for example an average measured tension value rather than the instantaneous value to decide when this is within or outside the range to verify the variation in the controlled tension value in relation to the predetermined value range in order to accelerate or decelerate passage from one operating mode to the other, to optimize the process.

Passage from one operating mode to the other could be entirely handled by the textile machine. In that case, the control device could be totally integrated into the electronic system controlling the machine (or if external to this electronic system it could communicate with it via a communication bus, for example) which, knowing the type of manufacture under way, can hence directly pass to the device the operating mode (constant tension or constant velocity), and also possibly the velocity at which the device has to feed the yarn to the machine.

The invention claimed is:

1. A method of feeding a spoolable material to a processing machine via a device at a desired tension and at a desired velocity, wherein the desired tension is within a desired tension range, wherein the desired velocity is constant and equal to a self-determined or predefined and programmable value, the device comprising:

a control unit, a velocity sensor monitored by the control unit, a tension sensor monitored by the control unit, an actuator controlled by the control unit, and a rotary member driven by the actuator, wherein the spoolable material cooperates with the rotary member and extends from the rotary member to the tension sensor;

the method comprising using the control unit to:

monitor, via the tension sensor, a measured tension of the spoolable material between the device and the processing machine;

monitor, via the velocity sensor, a measured rotational velocity of the rotary member;

control, based on the measured tension, the actuator to drive the rotary member to attempt to attain the desired tension;

upon attaining the desired tension, control, based on the measured rotational velocity, the actuator to drive the rotary member to attempt to attain the desired velocity; and upon deviating from the desired tension, control, based on the measured tension, the actuator to drive the rotary member to attempt to attain the desired tension, wherein if both tension and speed are constant, the control unit feeds the yarn at constant speed.

2. The method according to claim 1, further comprising using the control unit to evaluate a mean tension value, based on a plurality of measured tensions of the spoolable material between the device and the processing machine over a time period, wherein the desired tension range is a range of desired mean tension values; and halting the processing machine if, after a prefixed number of correction attempts, the desired tension is not attained.

3. The method, according to claim 1, wherein the method further comprises using the control unit to:

detect a discontinuous feed of the spoolable material to the processing machine based on a sudden deviation of the measured tension, and upon detecting the discontinuous feed, resume control, based on the measured tension, of the actuator to drive the rotary member to attempt to attain the desired tension, and upon attaining the desired tension, resume control, based on the measured rotational velocity, of the actuator to drive the rotary member to attempt to attain the desired velocity.

4. The method, according to claim 1, further comprising using the control unit to:

continuously monitor the measured rotational velocity upon attaining the desired tension, detect a discontinuous feed of the spoolable material to the processing machine based on a sudden deviation in the measured rotational velocity, upon detecting the discontinuous feed, resume control, based on the measured tension, of the actuator to drive the rotary member to attempt to attain the desired tension, and upon attaining the desired tension, resume control, based on the measured rotational velocity, of the actuator to drive the rotary member to attempt to attain the desired velocity.

5. The method according to claim 1, wherein the desired tension range is chosen to make an absorbed length value equal for a plurality of spoolable materials fed to the processing machine.

6. The method according to claim 1, wherein the desired tension range remains the same during production a single article.

7. The method according to claim 1, wherein the desired tension range varies during production of different parts of a single article.

8. The method according to claim 1, wherein the spoolable material is selected from the group consisting of yarn, thread, and combinations thereof.

9. The method according to claim 1, wherein using the control unit to control, based on the measured tension, the actuator to drive the rotary member to maintain the desired tension is effected in synchronization with the processing machine.

10. The method according to claim 1, wherein using the control unit control, based on the measured rotational velocity, the actuator to drive the rotary member to maintain the desired velocity is effected without synchronization with the processing machine.

11. The method according to claim 1, wherein the desired tension range varies after a first tension comparison with a first range of values.

12. A device for feeding a spoolable material to a processing machine at a desired tension and at a desired velocity, wherein the desired tension is within a desired tension range, wherein the desired velocity is constant and equal to a self-determined or predefined and programmable value, the device comprising:

a control unit, a velocity sensor monitored by the control unit, a tension sensor monitored by the control unit, an actuator controlled by the control unit, and a rotary member driven by the actuator, wherein the spoolable material cooperates with the rotary member and extends from the rotary member to the tension sensor;

the control unit being adapted to:

monitor, via the tension sensor, a measured tension of the spoolable material between the device and the processing machine;

monitor, via the velocity sensor, a measured rotational velocity of the rotary member;

control, based on the measured tension, the actuator to drive the rotary member to attempt to attain the desired tension;

upon attaining the desired tension, control, based on the measured rotational velocity, the actuator to drive the rotary member to attempt to attain the desired velocity; and upon deviating from the desired tension, control, based on the measured tension, the actuator to drive the rotary member to attempt to attain the desired tension, wherein if both tension and speed are constant, the control unit feeds the yarn at constant speed.

13. A device, according to claim 12, wherein the spoolable material is yarn, and wherein the device is a yarn feeder operating on the yarn unwinding by over end takeoff from a bobbin.

14. A device, according to claim 12, wherein the spoolable material is yarn, and wherein the device is a yarn feeder operating on the yarn unwinding by rolling takeoff, said yarn feeder comprising a body supporting the rotary member positioned in contact with a bobbin drawn onto a shaft rigidly affixed to the body and subjected to a traction element causing it to approach the rotary member, the body supporting the tension sensor member for the yarn.

15. A system for feeding a plurality of yarns or threads to a textile machine, comprising a respective device according to claim 12 for feeding each respective yarn, wherein a value of the yarn length absorbed by said devices which feed said yarns or threads is made uniform for at least part of these latter yarns or threads at the same value.

16. A system as claimed in claim 15, wherein said devices operate in master-slave configuration in which for each yarn type or production type only one of these devices is master while the others are slaves, said master device determining the feed velocity of all associated slave devices.

17. A system as claimed in claim 15, wherein each respective device operates on yarns of the same type, carries out the same type of production.

18. A method of feeding a plurality of spoolable materials to a processing machine via a plurality of devices, each at a desired tension and at a desired velocity, wherein each desired tension is within a desired tension range, wherein each desired velocity is constant and equal to a self-determined or predefined and programmable value, each device comprising:

a control unit, a velocity sensor monitored by the control unit, a tension sensor monitored by the control unit, an actuator controlled by the control unit, and a rotary member driven by the actuator, wherein each of the plurality of spoolable materials cooperates with a respective rotary member and extends from the respective rotary member to the tension sensor;

the method comprising using each control unit to:

monitor, via the tension sensor, a measured tension of one of the plurality of spoolable materials between one of the plurality of devices and the processing machine;

monitor, via the velocity sensor, a measured rotational velocity of the respective rotary member;

control, based on the measured tension, a respective actuator to drive the respective rotary member to attempt to attain the desired tension;

upon attaining the desired tension, control, based on the measured rotational velocity, the respective actuator to drive the respective rotary member to attempt to attain the desired velocity; and upon deviating from the desired tension, control, based on the measured tension, the actuator to drive the rotary member to attempt to attain the desired tension, wherein if both tension and speed are constant, the control unit feeds the yarn at constant speed.

* * * * *